US009150373B2

(12) United States Patent
Oh et al.

(10) Patent No.: US 9,150,373 B2
(45) Date of Patent: Oct. 6, 2015

(54) IMAGE FORMING APPARATUS

(75) Inventors: Myung-hun Oh, Daegu (KR); Je-won Jung, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 354 days.

(21) Appl. No.: 13/560,367

(22) Filed: Jul. 27, 2012

(65) Prior Publication Data

US 2013/0149018 A1 Jun. 13, 2013

(30) Foreign Application Priority Data

Dec. 13, 2011 (KR) ..... 10-2011-0133997

(51) Int. Cl.

| | |
|---|---|
| ***B65H 15/00*** | (2006.01) |
| ***B65H 29/60*** | (2006.01) |
| ***B41J 13/00*** | (2006.01) |
| ***G03G 15/00*** | (2006.01) |
| ***B41J 3/60*** | (2006.01) |
| *G03G 15/23* | (2006.01) |

(52) U.S. Cl.

CPC . *B65H 15/00* (2013.01); *B41J 3/60* (2013.01); *B41J 13/009* (2013.01); *B65H 29/60* (2013.01); *G03G 15/6529* (2013.01); *B65H 2301/33312* (2013.01); *G03G 15/234* (2013.01); *G03G 2215/00675* (2013.01)

(58) Field of Classification Search

CPC .. B65H 15/00; B65H 29/60; B65H 2301/332; B65H 2301/333; B65H 2301/3331; B65H 2301/33312; G03G 15/234; B41J 13/009

USPC ..... 271/186, 65, 301, 291; 399/364

See application file for complete search history.

(56) References Cited

U.S. PATENT DOCUMENTS 6,948,711 B2 * 9/2005 Kanai ..... 271/279
7,108,260 B2 * 9/2006 Biegelsen et al. ..... 271/303

FOREIGN PATENT DOCUMENTS

KR 10-2006-0005765 1/2006

* cited by examiner

*Primary Examiner* — Michael McCullough
(74) *Attorney, Agent, or Firm* — Staas & Halsey LLP

(57) ABSTRACT

An image forming apparatus includes a discharge path through which the recording medium that has passed through the printing path is discharged; a reverse path in which the recording medium that has passed through the printing path is reversed; a resupply path in which the recording medium which reversely travels along the reverse path is guided to the printing path; a connection portion in which the printing path, the discharge path, the reverse path, and the resupply path cross one another; and a first guide member that is disposed in the connection portion.

14 Claims, 9 Drawing Sheets

IMAGE FORMING APPARATUS

CROSS-REFERENCE TO RELATED APPLICATIONS

This application claims the priority benefit of Korean Patent Application No. 10-2011-0133997, filed on Dec. 13, 2011, in the Korean Intellectual Property Office, the disclosure of which is incorporated herein in its entirety by reference.

BACKGROUND

1. Field

The following description relates to an image forming apparatus, and more particularly, to an image forming apparatus capable of double-sided printing.

2. Description of the Related Art

In an electrophotographic image forming apparatus, light that is changed to correspond to image information is irradiated to a photoconductor to form an electrostatic latent image on a surface of the photoconductor, toner is supplied to the electrostatic latent image to develop the electrostatic latent image into a visible toner image, and then the visible toner image is transferred and fixed onto a recording medium, thereby printing an image on the recording medium.

In particular, a double-sided image forming apparatus is capable of printing an image on two sides of a recording medium such that the usage amount of recording media may be reduced compared to single-sided printing, and thus, is currently used by many users.

SUMMARY

Additional aspects and/or advantages will be set forth in part in the description which follows and, in part, will be apparent from the description, or may be learned by practice of the invention.

The following description relates to an image forming apparatus whereby the speed of double-sided printing may be increased and the weight and cost of the image forming apparatus may be minimized.

The following description relates to an image forming apparatus which may be simply installed to minimize installation costs thereof.

According to an aspect, an image forming apparatus may include a printing path in which an image is formed on a recording medium; a discharge path through which the recording medium that has passed through the printing path is discharged; a reverse path in which the recording medium that has passed through the printing path is reversed; a resupply path in which the recording medium which reversely travels along the reverse path is guided to the printing path; a connection portion in which the printing path, the discharge path, the reverse path, and the resupply path cross one another; and a first guide member that is disposed in the connection portion, wherein the first guide member has a first position through which the recording medium that has passed through the printing path is guided to the reverse path and a second position through which the recording medium that reversely travels along the reverse path is guided to the resupply path and is guided to the discharge path once the recording medium has passed through the printing path again.

A reverse roller may be disposed in the reverse path, wherein the reverse roller rotates forwardly to move the recording medium that has passed through the printing path in a forward direction and then rotates reversely to move the recording medium in a reverse direction.

The reverse path may be a single path including a path for guiding the recording medium from the printing path to the reverse roller and a path for guiding the recording medium from the reverse roller to the resupply path.

The image forming apparatus may include a main body unit including the printing path, the discharge path, and the resupply path; and a reverse unit including the reverse roller and the reverse path, wherein the reverse unit is detachably attached to the main body unit.

The image forming apparatus may further include a second guide member that is disposed in the connection portion, wherein the second guide member has a third position through which the recording medium that has passed through the printing path is guided to the discharge path and a fourth position through which the recording medium that reversely travels along the discharge path is guided to the resupply path; and a discharge roller that is disposed in the discharge path and rotates forwardly to move the recording medium that has passed through the printing path in forward direction and then rotates reversely to move the recording medium in a reverse direction so as to perform double-sided printing when the reverse unit is detached.

When the reverse unit is mounted on the main body unit, the second guide member may guide the recording medium on which printing is completed to the discharge path together with the first guide member.

The first guide member and the second guide member may rotate while interlocking with each other.

The first guide member may be at the second position when the reverse unit is detached.

The first guide member may be disposed in the main body unit.

According to an aspect, an image forming apparatus may include a main body unit including a printing path in which an image is formed on a recording medium, a discharge path through which the recording medium that has passed through the printing path is discharged, and a resupply path that branches off from a connection portion between the printing path and the discharge path and that guides the recording medium, on a surface of which an image is formed, to the printing path; a reverse unit including a reverse path that branches off from the connection portion and in which the recording medium that has passed through the printing path is reversed, wherein the reverse unit is detachably attached to the main body unit; a first guide member that is disposed in the connection portion and has a first position through which the recording medium that has passed through the printing path is guided to the reverse path and a second position through which the recording medium that reversely travels along the reverse path is guided to the resupply path; and a second guide member that is disposed in the connection portion and has a third position through which the recording medium that has passed through the printing path is guided to the discharge path and a fourth position through which the recording medium that reversely travels along the discharge path is guided to the resupply path.

The first guide member may guide the recording medium that has passed through the printing path to the discharge path when the first guide member is at the second position.

The first guide member may be at the second position when the reverse unit is detached. The first guide member may be disposed in the main body unit.

Because a single reverse path is included in the image forming apparatus, use of a roller and a guide member for guiding a recording medium along the path may be reduced, thereby minimizing an increase in weight and cost of the image forming apparatus due to a reversing unit.

Also, even when a reverse unit is mounted, there is no need to install an additional connection path, and thus, the costs and operating time for mounting may be minimized.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

The present general inventive concept will now be described more fully with reference to the accompanying drawings, in which exemplary embodiments are shown.

Figure 1:
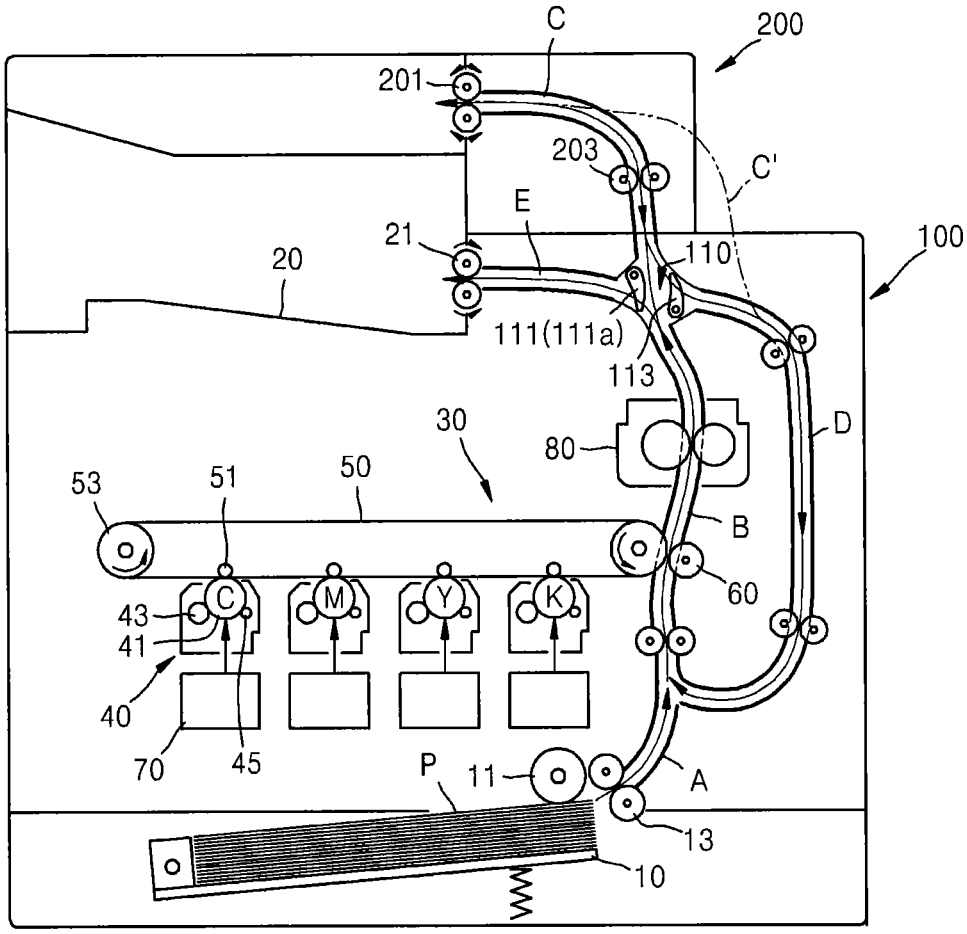
FIG. 1 is a schematic cross-sectional view illustrating an image forming apparatus.

FIG. 1 is a schematic cross-sectional view illustrating an image forming apparatus. First, referring to FIG. 1, an operation of forming an image by using the image forming apparatus will be described briefly.

Referring to FIG. 1, the image forming apparatus may include a feeding tray 10, a discharge tray 20, and a printing unit 30.

A pickup roller 11 picks up recording media P that is loaded in the feeding tray 10 sheet by sheet. A transporting roller 13 transports the picked up recording medium P toward the printing unit 30.

A discharge roller 21 discharges and loads the recording medium P that passed the printing unit 30 and is completely printed to the discharge tray 20.

The printing unit 30 is a unit for forming an image on the recording medium P. The printing unit 30 may include an exposure unit 70, a developer 40, an intermediate transfer belt 50, an intermediate transfer roller 51, a final transfer roller 60, and a fuser 80.

The exposing unit 70 irradiates light that is modulated to correspond to image information to a photoconductive drum 41 to form an electrostatic latent image. At the exposing unit 70, an LED type exposing unit in which a plurality of light-emitting diodes (LED) are arranged in a main scanning direction to emit light may be used. Also, for example, a laser scanning unit (LSU) that deflects light irradiated from a laser diode in a main scan direction by using a polygon mirror and that irradiates the deflected light to the photoconductive drum 41 may be used as the exposure unit 70.

The developer 40 attaches toner contained therein to the electrostatic latent image formed on the photosensitive drum 41 to form a toner image. The developer 40 may include a developing roller 43 that supplies a toner contained in the developer 40 to the electrostatic latent image formed on the photosensitive drum 41 and a discharge roller 45 that discharges a surface of the photosensitive drum 41 with a uniform potential.

A developing bias voltage is applied to the developing roller 43 to supply toner to the electrostatic latent image, and a charge bias voltage is applied to the discharge roller 45. Here, instead of the discharge roller 45, a corona charger may also be used. The photosensitive drum 41 is an example of a photo receptor on which an electrostatic latent image is formed. The photosensitive drum 41 may also be a photosensitive layer having photoconductivity formed on an external circumference of a cylindrical metal pipe.

The intermediate transfer belt 50 is an intermediate transfer medium to which a toner image is temporarily transferred before it is finally transferred to the recording medium P. The intermediate transfer belt 50 is supported by a plurality of support rollers 53 and circulates.

The intermediate transfer roller 51 is an example of an intermediate transfer member to transfer the toner image formed on the photosensitive drum 41 to the intermediate transfer belt 50. Four intermediate transfer rollers 51 are disposed to face four photosensitive drums 41 with the intermediate transfer belt 50 therebetween. An intermediate transfer bias voltage for transferring the toner image formed on the photosensitive drum 41 to the intermediate transfer belt 50 is applied to the intermediate transfer roller 51.

The final transfer roller 60 is an example of a final transfer unit for transferring the toner image on the intermediate transfer belt 50 to the recording medium P. A final transfer bias voltage for transferring a toner image on the intermediate transfer belt 50 to the recording medium P may be applied to the final transfer roller 60. Instead of the final transfer roller 60, a corona transferring unit may also be used. The fuser 80 applies heat and pressure to the toner image transferred to the recording medium P.

As illustrated in FIG. 1, a recording medium P is transported sequentially through a supply path A, a printing path B, a reverse path C, a resupply path D, the printing path B again, and a discharge path E to print on two sides of the recording medium P loaded in the feeding tray 10 and is discharged to the discharge tray 20.

Referring to FIG. 1, the supply path A is a path through which the recording medium P loaded in the feeding tray 10 is supplied, and the printing path B is a path through which an image is formed on the recording medium P. The reverse path C is a path through which the recording medium P transferred from the printing path B is reversed, and the resupply path D is a path through which the reversed recording medium P is resupplied to the printing path B. The discharge path E is a path through which the recording medium P that completed printing is discharged.

The recording medium P loaded in the feeding tray 10 passes through the supply path A and is transferred to the printing path B. To this end, the pickup roller 11 is installed at an end portion of the supply path A. The pickup roller 11 picks up the recording media P loaded in the feeding tray 10 sheet-by-sheet. The transporting roller 13 that is disposed adjacent to the pickup roller 11 transports the picked up recording medium P to the printing path B.

While the recording medium P passes through the printing path B, an image is formed on a surface of the recording medium P. To this end, the printing unit 30 is disposed at the printing path B. The recording medium P, on a surface of which an image is formed by the printing unit 30, may be discharged to the discharge tray 20 through the discharge path E or may be transferred to the reverse path C for double-sided printing.

In the reverse path C, the recording medium P of which one surface is printed is reversed so that the other surface of the recording medium P may be printed. In the reverse path C, first, the recording medium P that has passed through the printing path B travels in a forward direction on the same, reverse path C, and then travels in a reverse direction to be reversed. To this end, a reverse roller 201 that rotates forwardly or reversely to move the recording medium P in a forward or reverse direction may be disposed. In the reverse path C, a reverse auxiliary roller 203 may be further installed to assist the reverser roller 201. The reverse auxiliary roller 203 rotates with the reverse roller 201 forwardly or reversely and may assist moving of the recording medium P.

The reversed recording medium P passes through the resupply path D to be supplied to the printing path B, and thus, the other side of the recording medium P faces the printing unit 30.

The reverse path C is separately included from the discharge path E. While the recording medium P passes through the reverse path C, other recording medium P may pass through the printing path B and the discharge path E. To this end, even when the recording medium P is reversed in the reverse path C, an image may be printed on another recording medium P through the printing path B and the discharge path E, and thus, double-sided printing may be performed at an equivalent speed to that of single-sided printing.

The reverse path C may be a single path. That is, a forward path through which the recording medium P being discharged from the printing path B passes is the same as a reverse path through which the recording medium P supplied to the resupply path D passes. Accordingly, the size and weight of the image forming apparatus may be reduced while increasing the printing speed thereof.

According to the conventional art, a forward path C and a reverse path C' (denoted by a short-short-long dashed line) are separately formed to form the reverse path C, and thus, a gate that selectively opens or blocks the forward path C and the reverse path C', a roller for aiding transportation in the reverse path C', and an additional complicated installation operation for forming the reverse path C' are required. However, according to an embodiment, the forward path C and the reverse path C' are formed as a single path so that double-sided printing may be performed at a speed that is almost equivalent to that of single-sided printing just by a simple installation operation without having to install an additional structure as in the conventional art.

The reverse path C may branch off from a connection portion 110 where the printing path B, the discharge path E, and the resupply path D cross one another. Because the reverse path C is connected to the printing path B and the resupply path D, the recording medium P that has passed through the printing path B may be transported to the reverse path C, and the recording medium P that is transported in a reverse direction along the reverse path C may be transported to the resupply path D.

A first guide member 111 that guides a transfer direction of the recording medium P is disposed in the connection portion 110. The first guide member 111 may be moved to a first position 111*a* through which the recording medium P that has passed through the printing path B is guided to the reverse path C and a second position 111*b* (see FIGS. 3 and 5) through which the recording medium P that reversely travels along the reverse path C is guided to the resupply path D and is guided to the discharge path E once the printing is completed. The first guide member 111 may be moved to the first position 111*a* and the second position 111*b* in various manners. For example, the first guide member 111 may be pivotally installed and may be connected to a solenoid (not shown) to be selectively moved to the first position 111*a* and the second position 111*b* by a driving signal that is applied to the solenoid. However, the method of moving the first guide member 111 to the first position 111*a* and the second position 111*b* is not limited thereto, and various methods may be used to move the first guide member 111 to the first position 111*a* and the second position 111*b*.

In the resupply path D, the recording medium P that is transferred from the reverse path C is resupplied to the printing path B. To this end, a first end of the resupply path D is connected to the reverse path C, and a second end thereof is connected to the printing path B.

The discharge path E discharges the recording medium P on which printing is completed. A discharge roller 21 may be disposed at the discharge path E to discharge the recording medium P on which printing is completed.

FIGS. 2 through 5 illustrate a recording medium P that is being transported in the image forming apparatus according to an embodiment of the present general inventive concept. Among the recording media P loaded on a feeding tray 10, a first recording medium P1 that is picked up by a pick up roller 11 is passed through the supply path A by the transporting roller 13 to be transported toward the printing path B.

During the transport, the first recording medium P1 passes through the printing path B, an image is formed on a surface of the first recording medium P1 by the printing unit 30.

Figure 2:
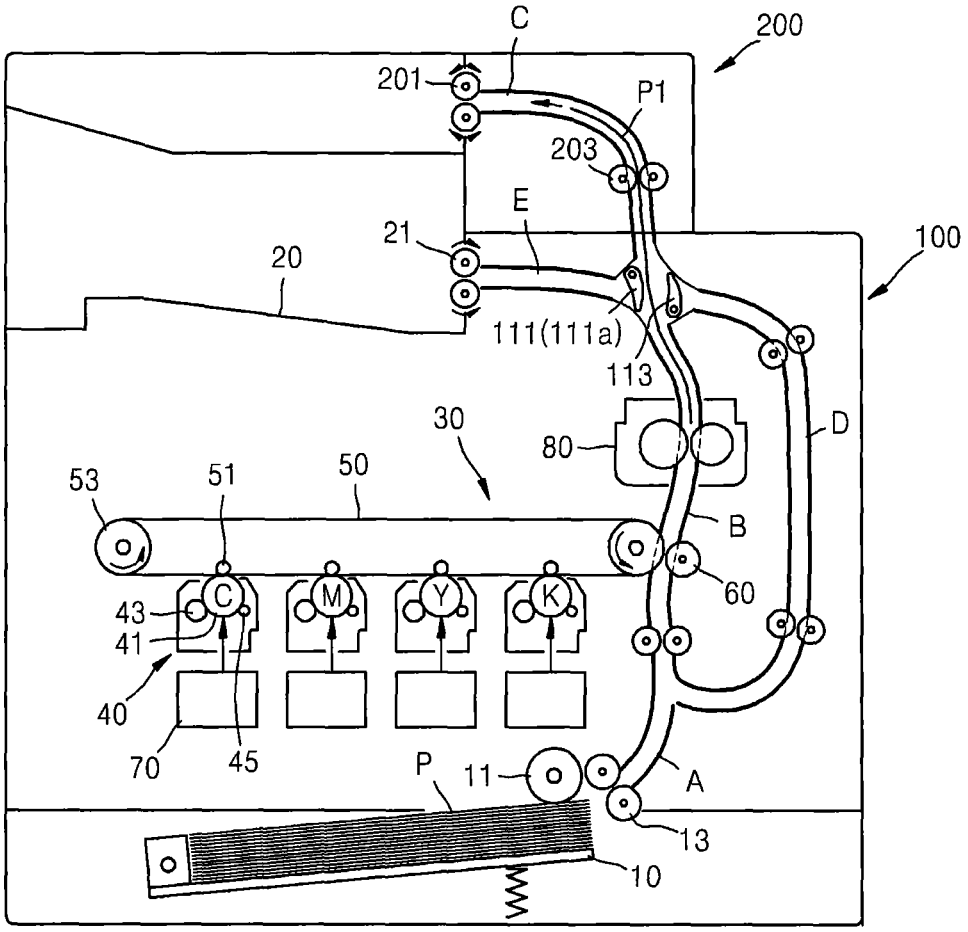
FIGS. 2 through 5 illustrate a recording medium that is being transported in an image forming apparatus.

Referring to FIG. 2, the first recording medium P1, on one surface of which an image is formed, is transported to the reverse path C. Here, the first guide member 111 that is disposed in the connection portion 110, in which the printing path B, the reverse path C, the discharge path E, and the resupply path D cross, is at the first position 111*a* to guide the first recording medium P1 to the reverse path C. Accordingly, the discharge path E is blocked, and the reverse path C is opened.

The first recording medium P1 that is guided by the first guide member 111 into the reverse path C is transported in a forward direction. After a terminal edge of the first recording medium P1 passes the fixing unit 80, the first recording medium P1 is transported in a forward direction by the reverse roller 201 and the reverse auxiliary roller 203.

Figure 3:
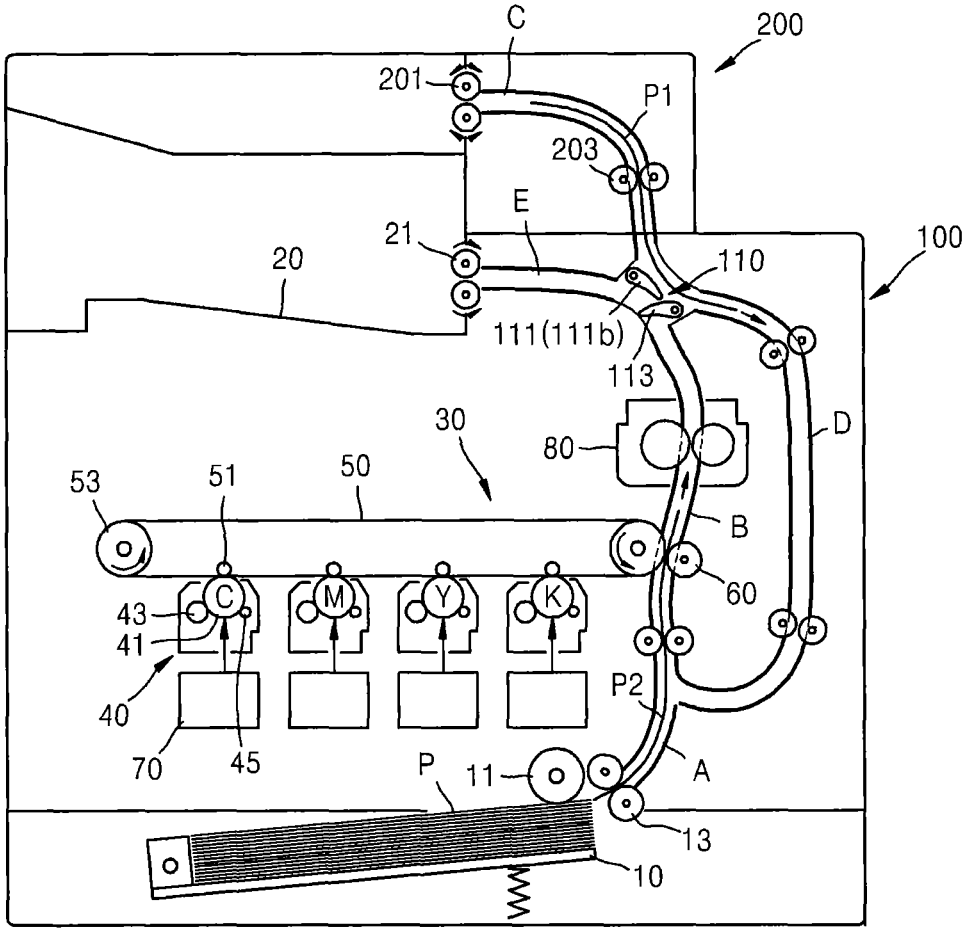

Referring to FIG. 3, the first recording medium P1 that reversely travels along the reverse path C is guided to the resupply path D. After the terminal edge of the first recording medium P1 completely passes the connection portion 110 (especially the first guide member 111), the first guide member 111 disposed at the connection portion 110 rotates anticlockwise to change to the second position 111*b* illustrated in FIG. 3. When the reverse roller 201 and the reverse auxiliary roller 203 rotate reversely, the first recording medium P1 reversely travels along the reverse path C. Because the first guide member 111 is converted to the second position 111*b*, the first recording medium P1 that reversely travels along the reverse path C is guided to the resupply path D. To improve speed of double-sided printing, a second recording medium P2 that is newly picked up by the pick up roller 11 may pass through the printing path B and an image may be formed on a surface of the second recording medium P2.

Figure 4:
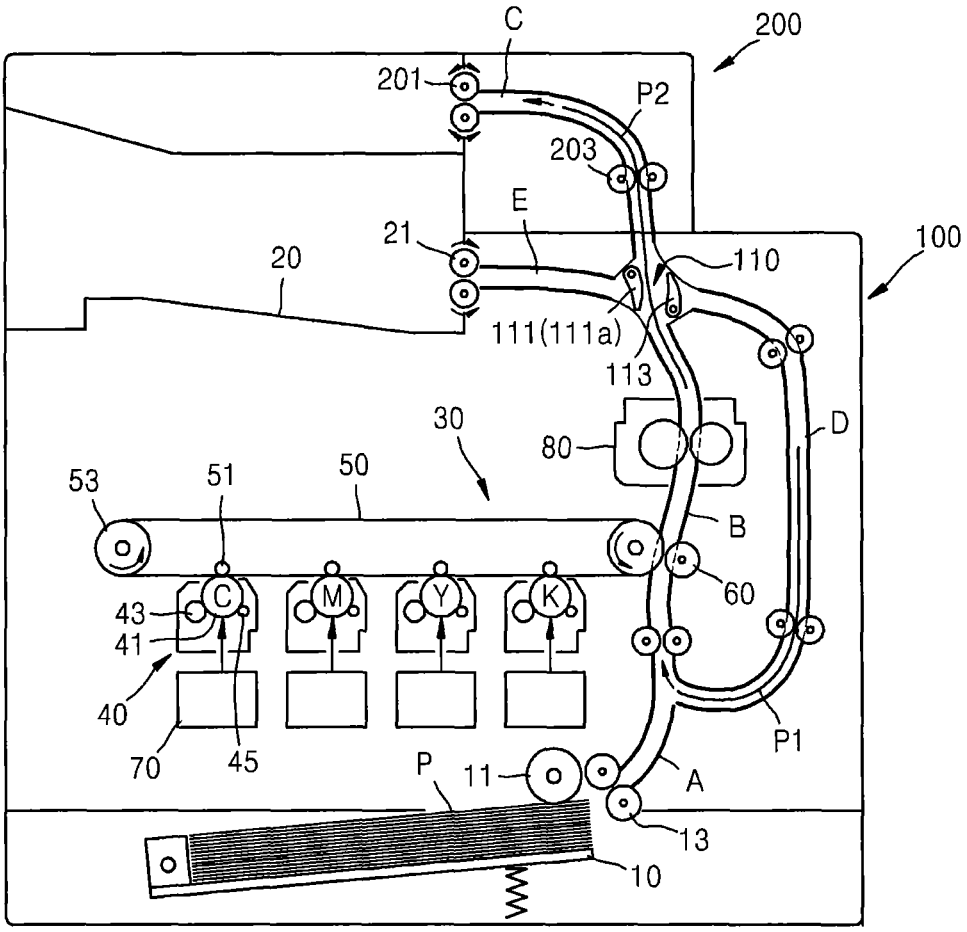

Referring to FIG. 4, the first recording medium P1 that is guided to the resupply path D passes by the resupply path D to be supplied to the printing path B again. The second recording medium P2 passes through the printing path B to be transported to the reverse path C, as illustrated in FIG. 4.

Figure 5:
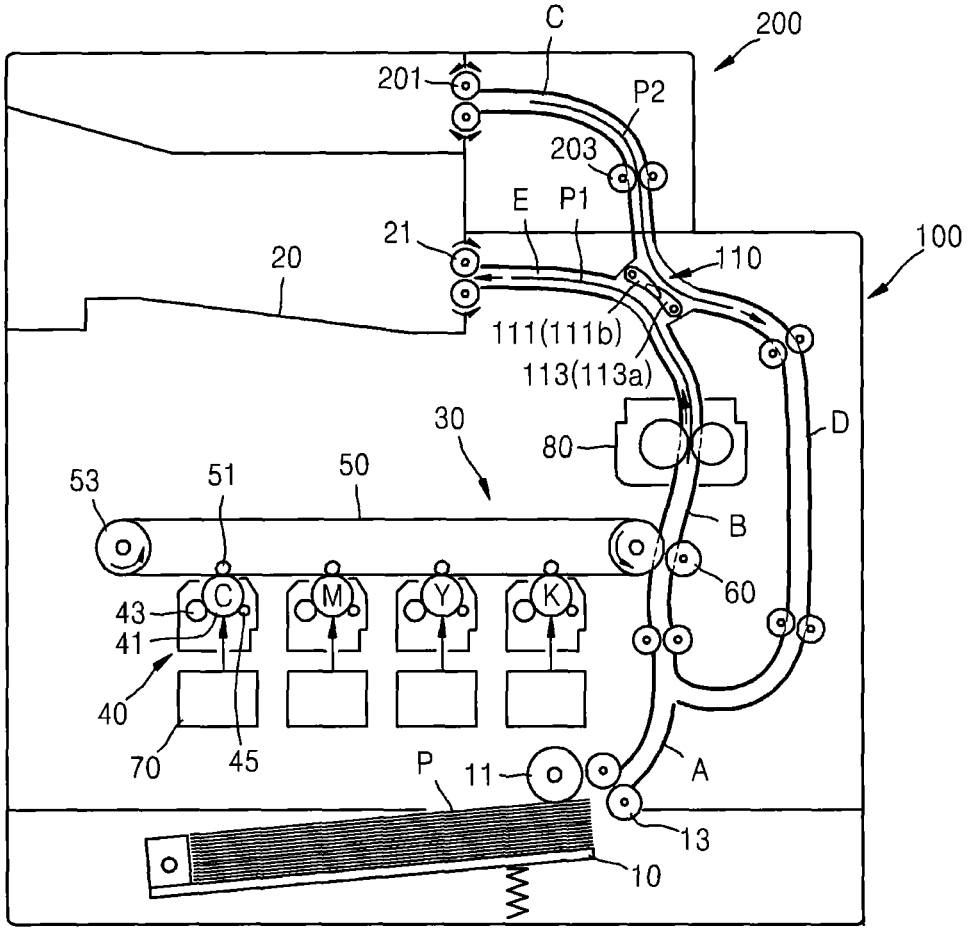

Referring to FIG. 5, the first recording medium P1 that is resupplied to the printing path B is guided to the discharge path E by the printing unit 30 after an image is formed on the other surface of the first recording medium P1, opposite to the surface which was printed previously. Here, the second recording medium P2 may reversely travel along the reverse path C to be transported to the resupply path D. Because the image forming apparatus according to the current embodiment of the present general inventive concept includes the reverse path C, which is a single path, the first recording medium P1 on which printing is completed and the second recording medium P2 that is reversed may simultaneously pass through the connection portion 110. In this case, in order to prevent collision of the first recording medium P1 and the second recording medium P2, the first guide member 111 is disposed at the second position 111*b* illustrated in FIG. 5. Because the first guide member 111 is disposed at the second position 111*b*, the first recording medium P1 on which printing is completed is guided to the discharge path E, and the reversed second recording medium P2 is guided to the resupply path D.

An image forming apparatus according to another embodiment of the present general inventive concept may be divided into a main body unit 100 and a reverse unit 200 that is detachably attached to the main body unit 100. The main body unit 100 may include the printing path B, the discharge path E, and the resupply path D, and the reverse unit 200 may include the reverse roller 201 and the reverse path C. The image forming apparatus according to the current embodiment of the present general inventive concept is the same as the image forming apparatus according to the previous embodiment except that the reverse unit 200 is detachably attached to the main body unit 100. Thus, description of the same components and configurations as in the previous embodiment is not provided.

Figure 6:
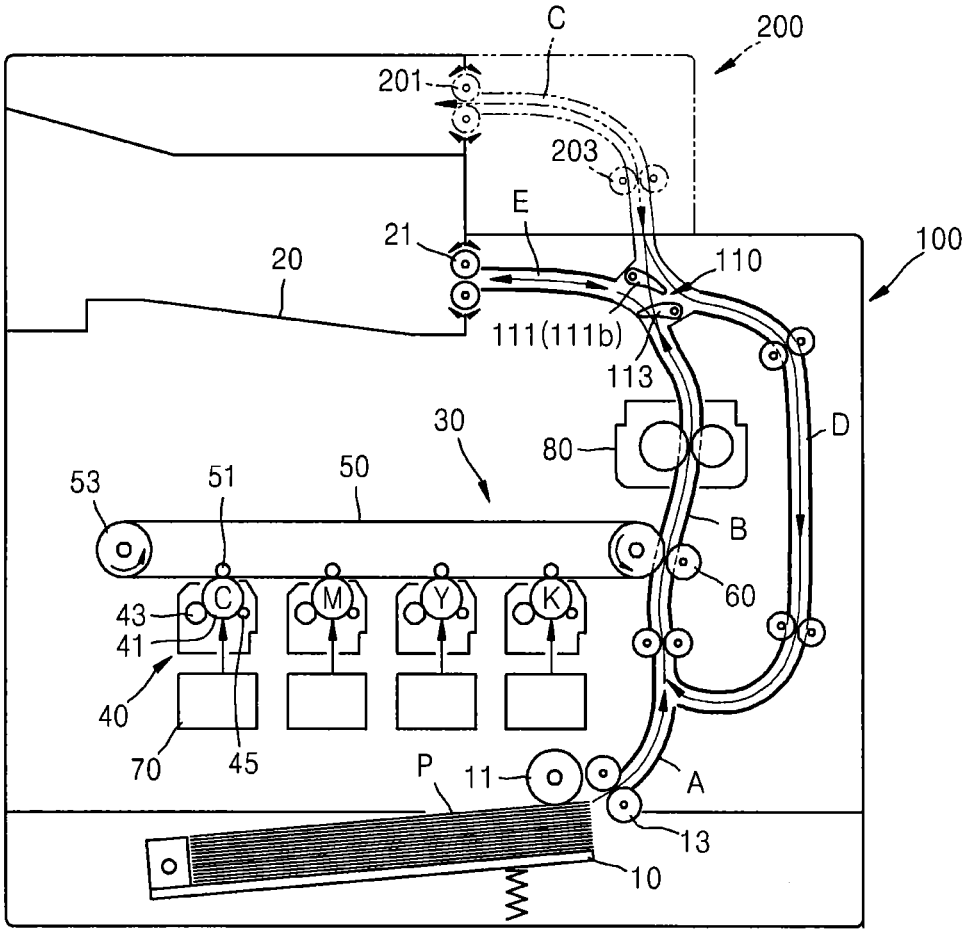
FIG. 6 is a cross-sectional view illustrating an image forming apparatus from which a reverse unit is detached.

FIG. 6 is a cross-sectional view illustrating an image forming apparatus from which a reverse unit is detached, according to another embodiment of the present general inventive concept. Referring to FIG. 6, according to the image forming apparatus from which the reverse unit 200 is detached of the current embodiment of the present general inventive concept, double-sided printing may also be performed even when the reverse unit 200 is detached.

To this end, a second guide member 113 is disposed in the connection portion 110, and the discharge roller 21 discharges in the discharge path E.

The second guide member 113 may be at a third position 113*a* (see FIG. 7) through which a recording medium P that has passed through a printing path B is guided to the discharge path E, or at a fourth position 113*b* (see FIG. 8) through which the recording medium P that reversely travels along the discharge path E is guided to the resupply path D. The second guide member 113 may be moved at the fourth position 113*b* by gravity. In this case, the second guide member 113 is changed to the third position 113*a* by the discharging recording medium P. After the recording medium P is discharged, the second guide member 113 may return to the fourth position 113*b* by gravity. In addition, the second guide member 113 may be elastically biased at the fourth position 113*b* by an elastic member (not shown). In this case, the second guide member 113 is moved to the third position 113*a* by the discharging recording medium P. After the recording medium P is discharged, the second guide member 113 may return to the fourth position 113*b* by an elastic force of the elastic member. The first guide member 111 may be at the second position 111*b* through which the recording medium P is guided to the discharge path E. The first guide member 111 and the second guide member 113 may have an alternating structure so as not to interfere with each other if the first guide member 111 is at the second position 111*b* and the second guide member 113 is at the third position 113*a*, as is described in detail below.

The discharge roller 21 may rotate in a forward or reverse direction. As the discharge roller 21 first rotates forwardly and then reversely in order to reverse the recording medium P, the recording medium P that has passed through the printing path B is first transported in the forward direction, and then again in the reverse direction to be guided to the resupply path D.

The recording medium P that is guided to the resupply path D passes through the printing path B again, thereby forming images on both sides of the recording medium P. The recording medium P, on two surfaces of which an image is formed, passes through the discharge path E to be discharged.

According to an image forming apparatus with the reverse unit 200 mounted, the recording medium P is reversed through the reverse path C to perform double-sided printing, as in the embodiment described with reference to FIGS. 2 through 5.

With the reverse unit 200 mounted on the main body unit 100, when a first recording medium P1 is transported to the reverse path C, the second guide member 113 is pushed by the transporting first recording medium P1 and is rotated clockwise as illustrated in FIG. 2. After the first recording medium P1 passes the second guide member 113, the second guide member 113 rotates counterclockwise by gravity or by an elastic force of an elastic member (not shown) to return to its original state, as illustrated in FIG. 3. In addition, when the second recording medium P2 is transported to the reverse path C, the second guide member 113 is pushed by the transporting second recording medium P2 and is rotated clockwise, as illustrated in FIG. 4, and then, after the second recording medium P2 has passed by the second guide member 113, the second guide member 113 returns to its original state. Also, when the first recording medium P1 and the second recording medium P2 pass simultaneously through the connection portion 110, the first guide member 111 is at the second position 111*b* and the second guide member 113 is at the third position 113*a*, as illustrated in FIG. 5. Here, the second guide member 113 may have a structure to interlock with the first guide member 111 so as not to interfere with the first guide member 111.

Figure 7:
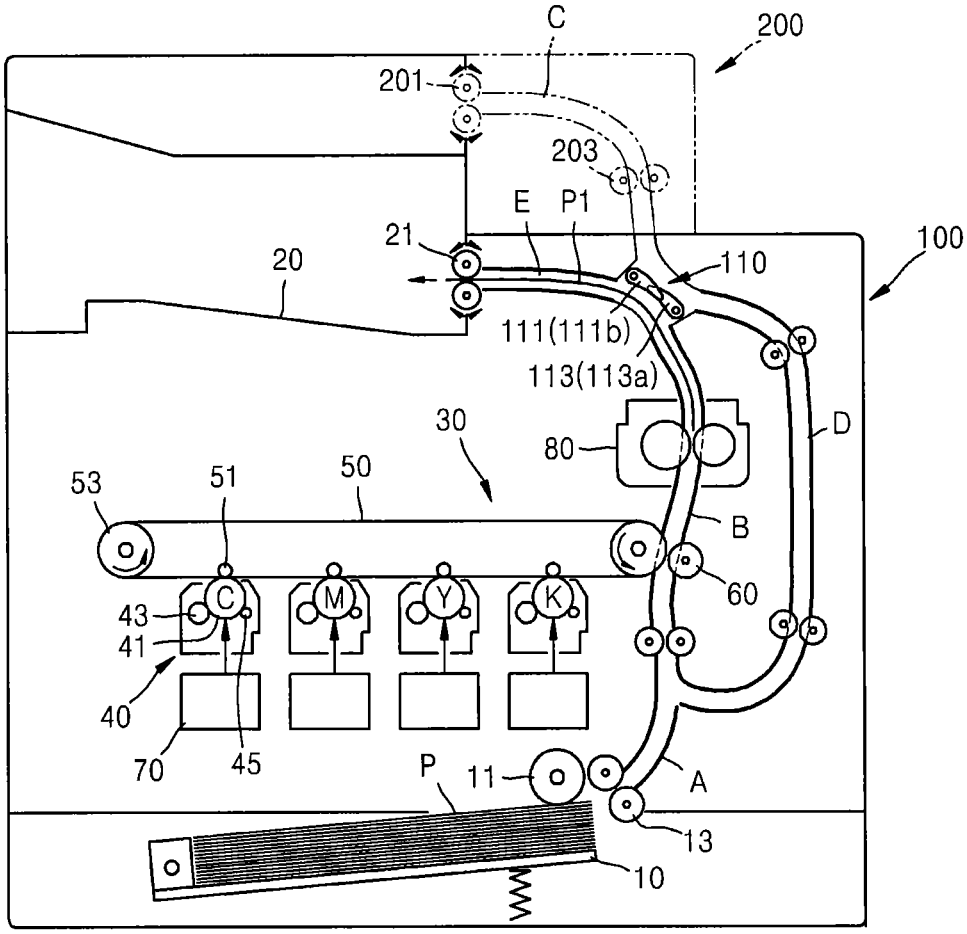
FIGS. 7 and 8 are schematic views illustrating a double-sided printing operation with a reverse unit detached from an image forming apparatus.
Figure 8:
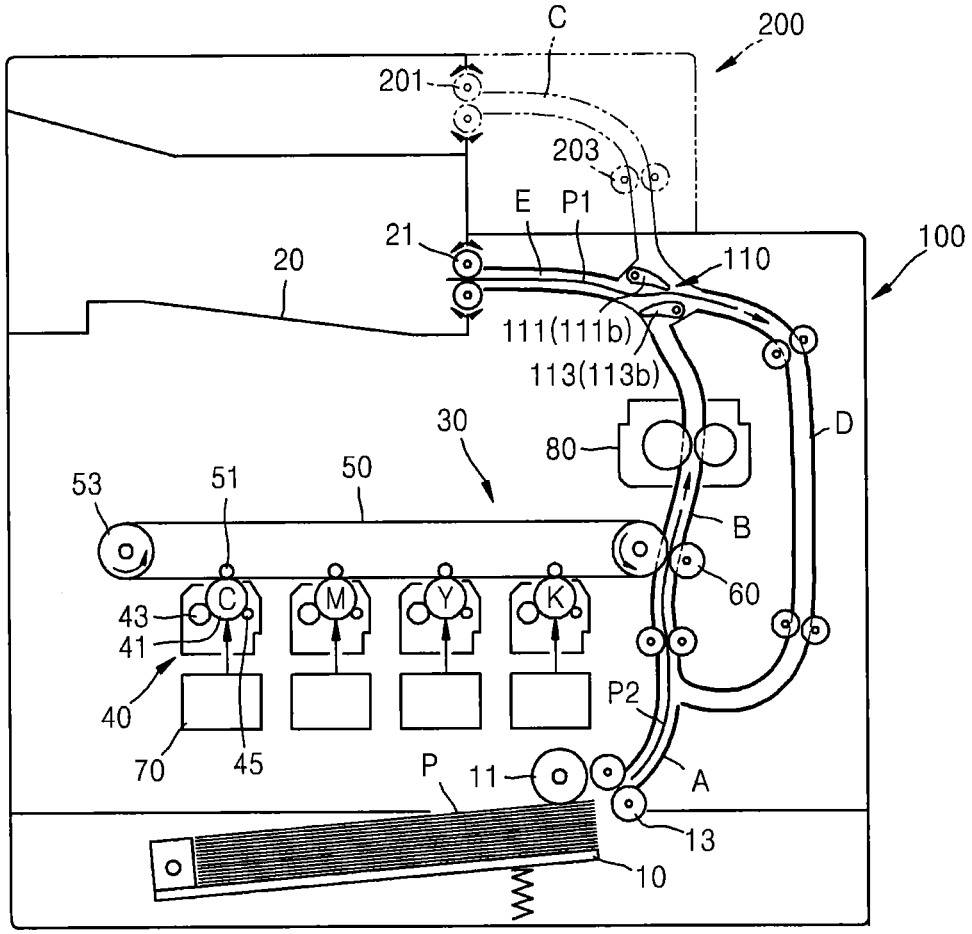

FIGS. 7 and 8 are schematic views illustrating a double-sided printing operation with a reverse unit detached from an image forming apparatus.

Referring to FIG. 7, a recording medium P passes through the supply path A and the printing path B to be transported to the discharge path E. When a first printing medium P1 passes through the connection portion 110 toward the discharge path E, the second guide member 113 is at the third position 113*a* through which the first recording medium P1 is guided to the discharge path E.

In single-sided printing, the first recording medium P1 transported to the discharge path E is discharged to the outside by forward rotation of the discharge roller 21. However, in double-sided printing, the discharge roller 21 rotates temporarily in a forward direction to expose the first printing medium P1 by a predetermined length to the outside and rotates in a reverse direction again, as illustrated in FIG. 8, to transport the first recording medium P1 to the resupply path D. While the first recording medium P1 is being transported to the resupply path D, a second recording medium P2 that is newly picked up by the pickup roller 11 may be transported to the printing path B. Here, the second guide member 113 is at the fourth position 113*b* at which the printing path B may be blocked and the resupply path D may be opened so that the first recording medium P1 transported from the discharge path E does not travel reversely to the printing path B but is transported to the resupply path D.

The first recording medium P1 that is transported to the resupply path D is transported to the printing path B, and an image is formed on the other surface of the first recording medium P1, where an image had not previously been formed by the printing unit 30.

The first recording medium P1 on which printing is completed on its two surfaces is guided to the discharge path E by the second guide member 113 at the third position 113*a* and is discharged to the outside by forward rotation of the discharge roller 21.

Figure 9:
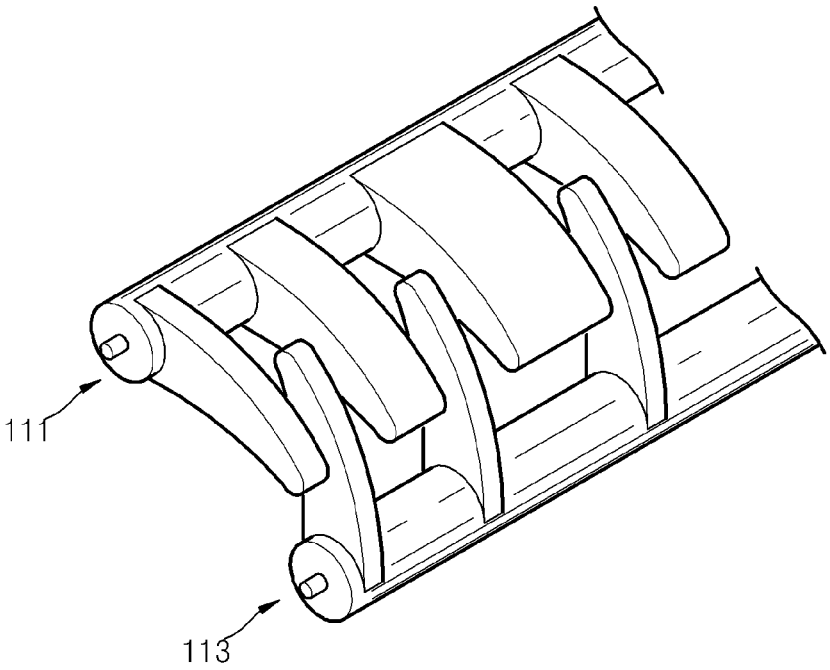
FIG. 9 is a partial perspective view illustrating a first guide member and a second guide member included in an image forming apparatus.

FIG. 9 is a partial perspective view illustrating the first guide member 111 and the second guide member 113 in an image forming apparatus.

The first guide member 111 and the second guide member 113 are arranged in the connection portion 110 where the printing path B, the discharge path E, the reverse path C, and the resupply path D cross one another. The first guide member 111 and the second guide member 113 are arranged in the connection portion 110, which is a narrow space, and thus, may interlock with each other. Because the first guide member 111 and the second guide member 113 interlock with each other, a jam, which may be caused by a gap between the first guide member 111 and the second guide member 113, may be prevented, and the reliability of the recording medium P may be improved.

The first guide member 111 and the second guide member 113 may interlock with each other in various manners. For example, the first guide member 111 and the second guide member 113 may interlock with each other in a zigzag structure. To this end, a plurality of guide bars of the first guide member 111 may be spaced apart in a lengthwise direction of a rotation axis, and a plurality of guide bars of the second guide member 113 may be arranged in the spaces between the plurality of guide bars of the first guide member 111.

While the present general inventive concept has been particularly shown and described with reference to exemplary embodiments thereof, the embodiments are exemplary. For example, although embodiments relate to a color image forming apparatus of a single pass type in which cyan (C), magenta (M), yellow (Y), and black (K) toners are used, the embodiments of the present general inventive concept are not limited thereto, and according to necessity, for example, an image forming apparatus may be a black and white image forming apparatus in which a black toner is used. Also, those of ordinary skill in the art understand that various changes in form and details may be made therein without departing from the spirit and scope of the present general inventive concept as defined by the following claims.

What is claimed is:

1. An image forming apparatus comprising:

a printing path in which an image is formed on a recording medium;

a discharge path through which the recording medium that has passed through the printing path is discharged;

a reverse path in which the recording medium that has passed through the printing path is reversed;

a resupply path in which the recording medium which reversely travels along the reverse path is guided to the printing path;

a connection portion in which the printing path, the discharge path, the reverse path, and the resupply path cross one another;

a first guide member that is disposed in the connection portion with a pivot axis in an upper portion of the connection portion, wherein the first guide member has a first position through which the recording medium that has passed through the printing path is guided to the reverse path and a second position through which the recording medium that reversely travels along the reverse path is guided to the resupply path and is guided to the discharge path once the recording medium has passed through the printing path again; and a second guide member that is disposed in the connection portion with a pivot axis in a lower portion of the connection portion, wherein the second guide member has a third position through which the recording medium that has passed through the printing path is guided to the discharge path and a fourth position through which the recording medium that reversely travels along the discharge path is guided to the resupply path.

2. The image forming apparatus of claim 1, wherein a reverse roller is disposed in the reverse path, wherein the reverse roller rotates forwardly to move the recording medium that has passed through the printing path in a forward direction and then rotates reversely to move the recording medium in a reverse direction.

3. The image forming apparatus of claim 2, wherein the reverse path is a single path including a path for guiding the recording medium from the printing path to the reverse roller and a path for guiding the recording medium from the reverse roller to the resupply path.

4. The image forming apparatus of claim 3, comprising:

a main body unit comprising the printing path, the discharge path, and the resupply path; and a reverse unit comprising the reverse roller and the reverse path, wherein the reverse unit is detachably attached to the main body unit.

5. An image forming apparatus comprising:

a printing path in which an image is formed on a recording medium;

a discharge path through which the recording medium that has passed through the printing path is discharged;

a reverse path in which the recording medium that has passed through the printing path is reversed;

a resupply path in which the recording medium which reversely travels along the reverse path is guided to the printing path;

a connection portion in which the printing path, the discharge path, the reverse path, and the resupply path cross one another;

a first guide member that is disposed in the connection portion, wherein the first guide member has a first position through which the recording medium that has passed through the printing path is guided to the reverse path and a second position through which the recording medium that reversely travels along the reverse path is guided to the resupply path and is guided to the discharge path once the recording medium has passed through the printing path again;

a second guide member that is disposed in the connection portion, wherein the second guide member has a third position through which the recording medium that has passed through the printing path is guided to the discharge path and a fourth position through which the recording medium that reversely travels along the discharge path is guided to the resupply path; and a discharge roller that is disposed in the discharge path and rotates forwardly to move the recording medium that has passed through the printing path in forward direction and then rotates reversely to move the recording medium in a reverse direction so as to perform double-sided printing when a detachable reverse unit, comprising a reverse roller disposed in the reverse path and the reverse path, is detached.

6. The image forming apparatus of claim 5, wherein when the reverse unit is mounted on a main body unit comprising the printing path, the discharge path and the resupply path, the second guide member guides the recording medium on which printing is completed to the discharge path together with the first guide member.

7. The image forming apparatus of claim 5, wherein the first guide member and the second guide member rotate while interlocking with each other.

8. The image forming apparatus of claim 5, wherein the first guide member is at the second position when the reverse unit is detached.

9. The image forming apparatus of claim 8, wherein the first guide member is disposed in a main body unit comprising the printing path, the discharge path and the resupply path.

10. An image forming apparatus comprising:

a main body unit comprising a printing path in which an image is formed on a recording medium, a discharge path through which the recording medium that has passed through the printing path is discharged, and a resupply path that branches off from a connection portion between the printing path and the discharge path and that guides the recording medium, on a surface of which an image is formed, to the printing path;

a reverse unit comprising a reverse path that branches off from the connection portion and in which the recording medium that has passed through the printing path is reversed, wherein the reverse unit is detachably attached to the main body unit;

a first guide member that is disposed in the connection portion with a pivot axis in an upper portion of the connection portion and has a first position through which the recording medium that has passed through the printing path is guided to the reverse path and a second position, different from the first position, through which the recording medium that reversely travels along the reverse path is guided to the resupply path; and a second guide member that is disposed in the connection portion with a pivot axis in a lower portion of the connection portion and has a third position through which the recording medium that has passed through the printing path is guided to the discharge path and a fourth position, different from the third position, through which the recording medium that reversely travels along the discharge path is guided to the resupply path, wherein the printing path, the discharge path, the reverse path, and the resupply path cross one another in the connection portion.

11. The image forming apparatus of claim 10, wherein the first guide member guides the recording medium that has passed through the printing path to the discharge path when the first guide member is at the second position.

12. The image forming apparatus of claim 11, wherein the first guide member is at the second position when the reverse unit is detached.

13. An image forming apparatus comprising:

a main body unit comprising a printing path in which an image is formed on a recording medium, a discharge path through which the recording medium that has passed through the printing path is discharged, and a resupply path that branches off from a connection portion between the printing path and the discharge path and that guides the recording medium, on a surface of which an image is formed, to the printing path;

a reverse unit comprising a reverse path that branches off from the connection portion and in which the recording medium that has passed through the printing path is reversed, wherein the reverse unit is detachably attached to the main body unit;

a first guide member that is disposed in the connection portion and has a first position through which the recording medium that has passed through the printing path is guided to the reverse path and a second position through which the recording medium that reversely travels along the reverse path is guided to the resupply path; and a second guide member that is disposed in the connection portion and has a third position through which the recording medium that has passed through the printing path is guided to the discharge path and a fourth position through which the recording medium that reversely travels along the discharge path is guided to the resupply path, wherein the first guide member guides the recording medium that has passed through the printing path to the discharge path when the first guide member is at the second position, is at the second position when the reverse unit is detached, and is disposed in the main body unit.

14. A method to form an image on two sides of a recording medium, the method comprising:

passing the recording medium through a printing path to form an image on a first side of the recording medium;

passing the recording medium through a connection portion using a first guide member with a pivot axis in an upper portion of the connection portion to guide the recording medium into a reverse path or a discharge path;

passing the recording medium through the connection portion using a second guide member with a pivot axis in a lower portion of the connection portion to guide the recording medium from the reverse path into a resupply path;

passing the recording medium through the printing path to form an image on a second side of the recording medium; and passing the recording medium through the connection portion using the first guide member to guide the recording medium into the discharge path, wherein the printing path, the discharge path, the reverse path, and the resupply path cross one another in the connection portion, and the first and second guide members interlock in the connection portion.

* * * * *